US012285842B2

(12) United States Patent
Chan et al.

(10) Patent No.: US 12,285,842 B2
(45) Date of Patent: Apr. 29, 2025

(54) PROBE GRINDING DEVICE BY ACOUSTIC POSITIONING

(71) Applicant: GLTTEK CO., LTD., Hsinchu (TW)

(72) Inventors: Hsun Hao Chan, Hsinchu (TW); Pei Hua Chang, Hsinchu (TW)

(73) Assignee: GLTTEK CO., LTD., Hsinchu (TW)

( * ) Notice: Subject to any disclaimer, the term of this patent is extended or adjusted under 35 U.S.C. 154(b) by 514 days.

(21) Appl. No.: 17/883,424

(22) Filed: Aug. 8, 2022

(65) Prior Publication Data

US 2023/0095121 A1 Mar. 30, 2023

(30) Foreign Application Priority Data

Sep. 29, 2021 (TW) ..... 110136304

(51) Int. Cl.

| | |
|---|---|
| ***B24B 49/00*** | (2012.01) |
| ***B24B 7/04*** | (2006.01) |
| ***B24B 49/12*** | (2006.01) |
| ***B24B 49/16*** | (2006.01) |

(52) U.S. Cl.

CPC ..... *B24B 49/003* (2013.01); *B24B 7/04* (2013.01); *B24B 49/006* (2013.01); *B24B 49/12* (2013.01); *B24B 49/16* (2013.01)

(58) Field of Classification Search

CPC ..... B24B 49/003; B24B 49/006; B24B 49/12; B24B 49/16; B24B 7/04

See application file for complete search history.

(56) References Cited

U.S. PATENT DOCUMENTS

| | | | | |
|---|---|---|---|---|
| 11,745,307 | B2 * | 9/2023 | Chen | B24B 49/12 451/28 |
| 11,822,308 | B2 * | 11/2023 | Zhang | G05B 19/404 |
| 2023/0095121 | A1 * | 3/2023 | Chan | B24B 7/04 438/5 |
| 2023/0194477 | A1 * | 6/2023 | Suzuki | B24B 49/10 451/8 |
| 2024/0408720 | A1 * | 12/2024 | Kadono | B24B 49/16 |

FOREIGN PATENT DOCUMENTS

| | | | | |
|---|---|---|---|---|
| CN | 109834577 A | * | 6/2019 | B24B 37/005 |

OTHER PUBLICATIONS

CN 109834577 A, Machine English translation (Year: 2025).*

* cited by examiner

*Primary Examiner* — Jose R Diaz

(74) *Attorney, Agent, or Firm* — Rosenberg, Klein & Lee

(57) ABSTRACT

A probe grinding device by acoustic positioning includes a fixing base, a grinding base, a rotating module, a motor module, a moving module, a processing module, an acoustic sensing module, and a memory module. The fixing base fixes a probe card. The acoustic sensing module generates and transmits an acoustic sensing signal to the processing module. The memory module stores a grinding audio of a grinding audio data. When the processing module drives the rotating module and the moving module via the motor module, the processing module determines whether the acoustic sensing signal matches the grinding audio. When the acoustic sensing signal matches the grinding audio, the processing module drives the moving module to slowly move the grinding base to avoid damaging the probes.

12 Claims, 4 Drawing Sheets

PROBE GRINDING DEVICE BY ACOUSTIC POSITIONING

CROSS-REFERENCE TO RELATED APPLICATIONS

This application claims the benefit of the filing date of Taiwan Patent Application No. 110136304, filed on Sep. 29, 2021, in the Taiwan Intellectual Property Office, the disclosure of which is incorporated herein in its entirety by reference.

BACKGROUND OF THE INVENTION

1. Field of the Invention

The present invention relates to a probe grinding device, in particular to a probe grinding device by acoustic positioning.

2. Description of the Related Art

The conventional probe grinding machine has a dilemma for grinding probes of a probe card. Before a grinding base of the probe grinding machine touches and grinds the probe of the probe card, it is necessary to be exquisitely controlled for a grinding force between the grinding base and the probe to preserve grinding quality. Consequently, a normal force between the grinding base and the probes needs to be strictly controlled. That is, the grinding base needs to move toward the probes slowly to avoid the normal force sharply arising when the grinding base touches the probes. Otherwise, the probes may be fractured. However, in this way, slowly moving the grinding base to the position that the probes can be grinded by the grinding base toward the probes will waste much time before the grinding base touches the probes. Hence, for the conventional probe grinding machine, the grinding efficiency can be improved for clearly positioning the grinding base and the probes so that the grinding base can be quickly moved toward the probes before touching the probes. In addition, the moving velocity of the grinding base can slow down after the grinding base approximately touches the probes.

The conventional probe grinding machine utilizes image information of optical lenses to position the positions of the grinding base and the probes. However, there are plenty of probes disposed on the probe card and many probes have a size of a micrometer scale. Since optical lenses fail to perfectly regulate a focal length, the endpoint of each probe can be located accurately. Therefore, most optical lenses cannot clearly determine when the grinding base touches the probes. Under this condition, the image information of the optical lenses is utilized to approximately locate the positions of the grinding base and the probes via a finite resolution but cannot clearly determine the moment that the grinding base touches the probes.

SUMMARY OF THE INVENTION

In view of this, the present invention provides a probe grinding device by acoustic positioning, comprising:

a fixing base, adapted to fix a probe card;

a grinding base, comprising a grinding surface, and the grinding surface facing to the fixing base; wherein when the probe card is fixed on the fixing base, a plurality of probes of the probe card face to the grinding base;

a rotating module, connected to the grinding base;

a moving module, connected to the rotating module;

a motor module, connected to the rotating module and the moving module;

a processing module, electrically connected to the motor module and generating a driving signal to the motor module; wherein the motor module drives the rotating module to rotate the grinding base and drives the moving module to move the grinding base toward the fixing base according to the driving signal;

an acoustic sensing module, electrically connected to the processing module, sensing sound to generate an acoustic sensing signal, and transmitting the acoustic sensing signal to the processing module;

a memory module, electrically connected to the processing module, storing a grinding audio data; wherein the grinding audio data comprises a grinding audio;

wherein when the processing module drives the rotating module and the moving module via the motor module, the processing module further determines whether the acoustic sensing signal matches the grinding audio stored in the memory module;

wherein when the processing module determines that the acoustic sensing signal matches the grinding audio, the processing module drives the moving module via the motor module to slow down a moving velocity of the grinding base.

The acoustic sensing module of the present invention is capable of sensing the acoustic generated by rubbing the grinding surface of the grinding base with the probes when the grinding surface touches the probes. The acoustic sensing module generates the acoustic sensing signal according to the acoustic and transmits the acoustic sensing signal to the processing module. When the processing module determines that the acoustic sensing signal matches the grinding audio, the motor module drives the moving module to slow down so that the acoustic sensing module acoustic can perform its function according to the acoustic sensing signal to locate the positions of the grinding base and the probes and react real time when the grinding base touches the probes. When the grinding base touches the probes, the rubbing noise will be generated. If the rubbing noise matches the grinding audio, the acoustic sensing module of the present invention can clearly determine when the grinding base touches the probes.

DETAILED DESCRIPTION OF THE INVENTION

Figure 1:
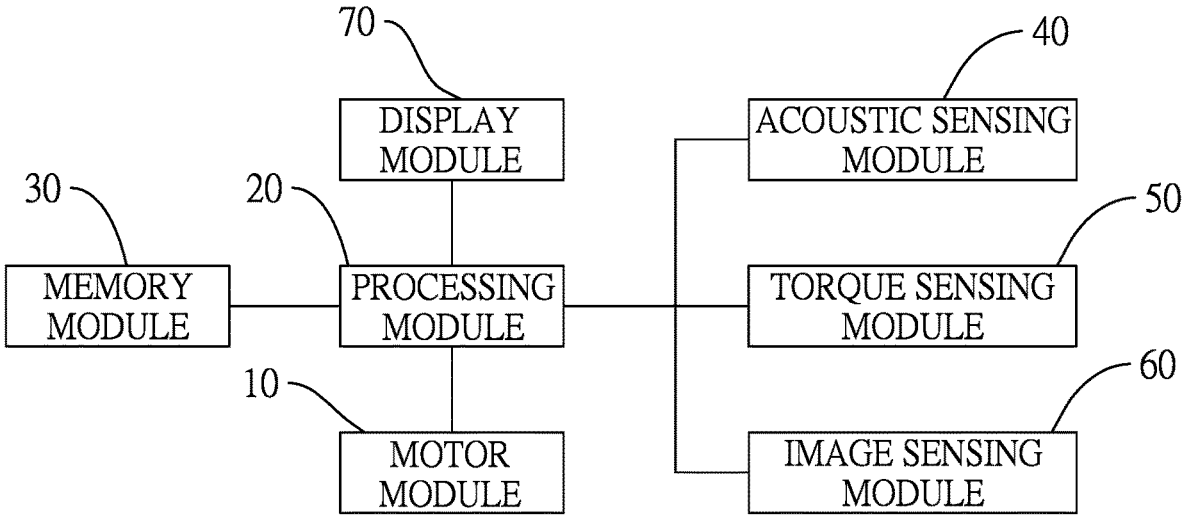
FIG. 1 is a block diagram of the probe grinding device by acoustic positioning in a first embodiment of the present invention.
Figure 2:
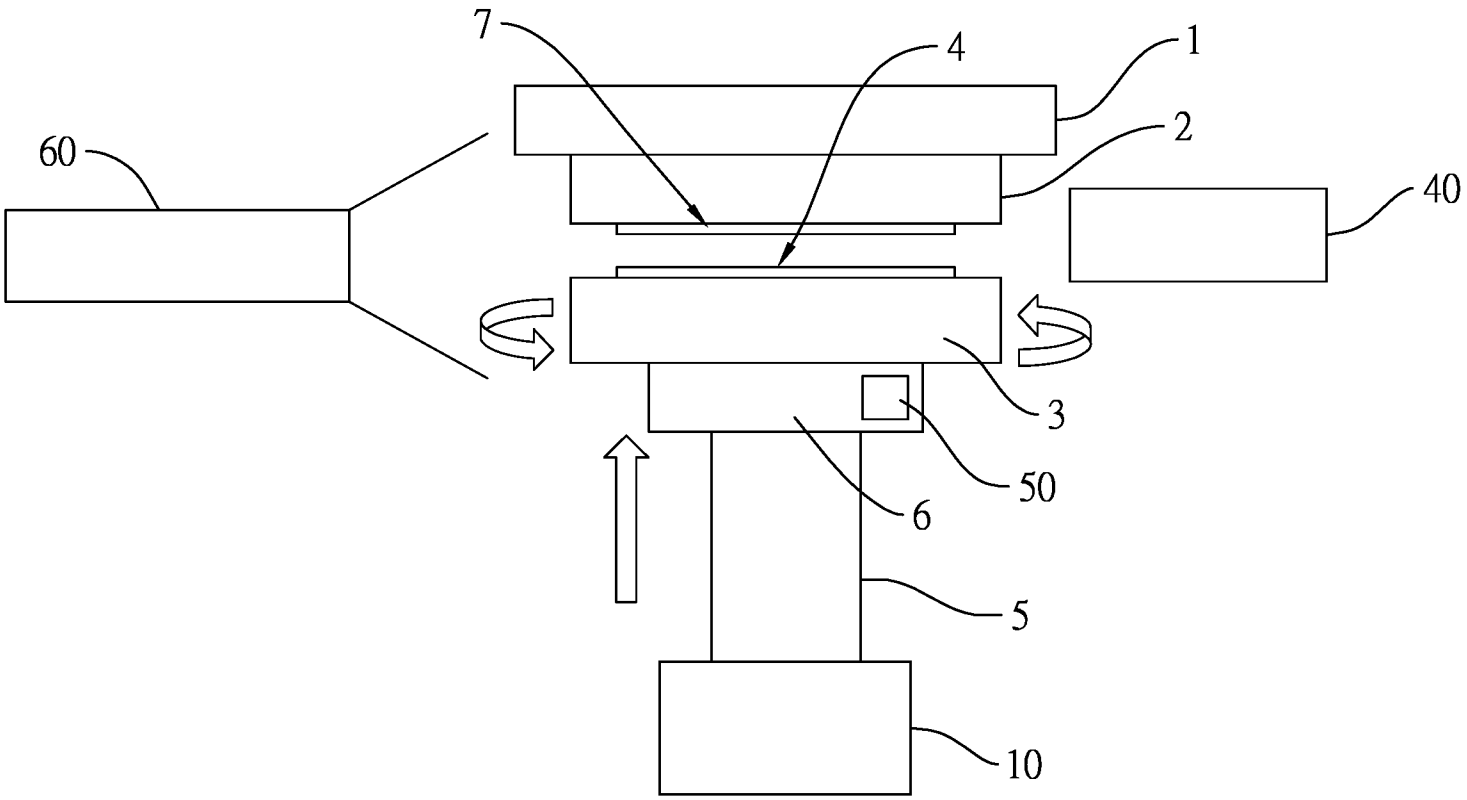
FIG. 2 is a side view of the probe grinding device by acoustic positioning of the first embodiment of the present invention.

Refer to FIG. 1 and FIG. 2. The present invention provides a probe grinding device by acoustic positioning. The probe grinding device by acoustic positioning includes a fixing base 1, a grinding base 3, a moving module 5, a rotating module 6, a motor module 10, a processing module 20, a memory module 30, and an acoustic sensing module 40. The fixing base 1 fixes a probe card 2. The probe card 2 includes a plurality of probes 7. Each of the probes 7 of the probe card 2 has a micrometer scale (m) size and a distinct length. The probes 7 are disposed on the probe card 2. The grinding base 3 includes a grinding surface 4. The grinding surface 4 faces to the fixing base 1. In other words, the grinding surface 4 faces to the probes 7 of the probe card 2. The rotating module 6 is connected to the grinding base 3. The moving module 5 is connected to the rotating module 6. The motor module 10 is connected to the rotating module 6 and the moving module 5. The processing module 20 is electrically connected to the motor module 10. The processing module 20 generates a driving signal to the motor module 10. The motor module 10 drives the rotating module 6 to rotate the grinding base 3 and drives the moving module 5 to move the grinding base 3 toward the fixing base 1 according to the driving signal.

In details, in the first embodiment of the present invention, the motor module 10 includes at least two motors. At least one of the motors drives the rotating module 6, and at least one of the other motors drives the moving module 5. When the moving module 5 moves the grinding base 3 toward the fixing base 1, the rotating module 6 follows the moving module 5 and moves towards the fixing base 1. When the rotating module 6 rotates the grinding base 3, the moving module 5 independently moves and is not affected by the rotating module 6. That is, at least two motors for respectively driving the rotating module 6 and the moving module 5 are respectively disposed on the moving module 5. In this way, the moving module 5 and the rotating module 6 are respectively connected to the motor module 10 and are respectively driven by the motor module 10.

The memory module 30 is electrically connected to the processing module 20 and stores a grinding audio data. The grinding audio data includes a grinding audio. The acoustic sensing module 40 is electrically connected to the processing module 20. The acoustic sensing module 40 senses sound to generate an acoustic sensing signal and transmits the acoustic sensing signal to the processing module 20. When the processing module 20 generates the driving signal to the motor module 10 to drive the rotating module 6 and the moving module 5, the processing module 20 further determines whether the acoustic sensing signal matches the grinding audio stored in the memory module 30. When the processing module 20 determines that the acoustic sensing signal matches the grinding audio, the processing module 20 generates a decelerating signal to the motor module 10. The motor module 10 drives the moving module 5 to decelerate a moving velocity of the grinding base 3 according to the decelerating signal. In this way, the probe grinding device by acoustic positioning of the present invention prevents the probes 7 from fracturing because the grinding base 3 moves so fast that the grinding surface 4 of the grinding base 3 generates a grinding force that is too strong.

The grinding audio data stored in the memory module 30 is a database of a grinding audio. The database stores the multiple categories of the grinding audio for distinct probes. That is, the database includes multiple categories of the grinding audio generated by grinding different probe materials, grinding different probe amounts, and grinding different probe diameters. As the probe material, amount, and the diameter vary, the frequency of the grinding audio follows the variations. Consequently, before the probes 7 are grinded, the probe grinding device by acoustic positioning of the present invention sets the grinding audio corresponding to the probes 7 so that the processing module 20 can detect whatever the grinding audio is. In addition, background noise and non-grinding audio can be excluded. Moreover, the acoustic sensing module 40 needs to detect a frequency band corresponding to the grinding audio to sense the corresponding sound to grind the probe. The grinding audio in the embodiment is approximately the frequency from 5 kilo hertz (kHz) to 15 kHz, but not limited thereto.

In the first embodiment, the motor module 10 drives the rotating module 6 and the grinding base 3 to move upward. The probe card 2 is fixed on the fixing base 1. The probes 7 of the probe card 2 extend downward and face to the grinding surface 4 of the grinding base 3. The memory module 30 stores a first velocity data, a second velocity data, a third velocity data, a setting position data, and a reference data. The present invention further includes a torque sensing module 50, an image sensing module 60, and a display module 70. In details, the reference data stored in the memory module 30 further includes a predetermined grinding distance, a time period, a reference value, and a security value. The setting position data includes a setting position. The setting position is the position to which the grinding base 3 moves before the grinding base 3 touches the probes 7. In other words, a first distance is between the fixing base 1 and the setting position. When the probe card 2 is fixed on the fixing base 1, a second distance is between the probe tips of the probes of the probe card 2 and the fixing base 1. Since the first distance is more than the second distance, when the grinding base 3 moves toward the fixing base 1, the grinding base 3 first moves to the setting position so as not to touch the probe tips of the probes. Since the user cannot determine when the grinding base 3 touches the probes 7 and the position that the grinding base 3 touches the probes 7, the setting position is set with a safe distance. For instance, the setting position is set with a distance, approximately 2 centimeters, away from the fixing base 1. The reason is that the length of the probes 7 should be less than 1 centimeter.

The image sensing module 60 is electrically connected to the processing module 20. The image sensing module 60 senses an image to generate an image sensing signal and transmits the image sensing signal to the processing module 20. When the processing module 20 generates the driving signal to the motor module 10 so that the motor module 10 rotates and moves the rotary axis according to the driving signal, the processing module 20 determines whether the grinding base 3 moves to the setting position (S2) according to the image sensing signal. When the processing module 20 determines that the grinding base 3 moves to the setting position, the processing module 20 generates a decelerating signal to the motor module 10. The motor module 10 decelerates the velocity of the rotating module 6. The moving velocity of the grinding base 3 slows down with the rotating module 6. It should be noted that the setting position is a relative position, that is, the position of the grinding surface 4 of the grinding base 3 relates to the position of the probe tip of the probe 7.

Figure 3:
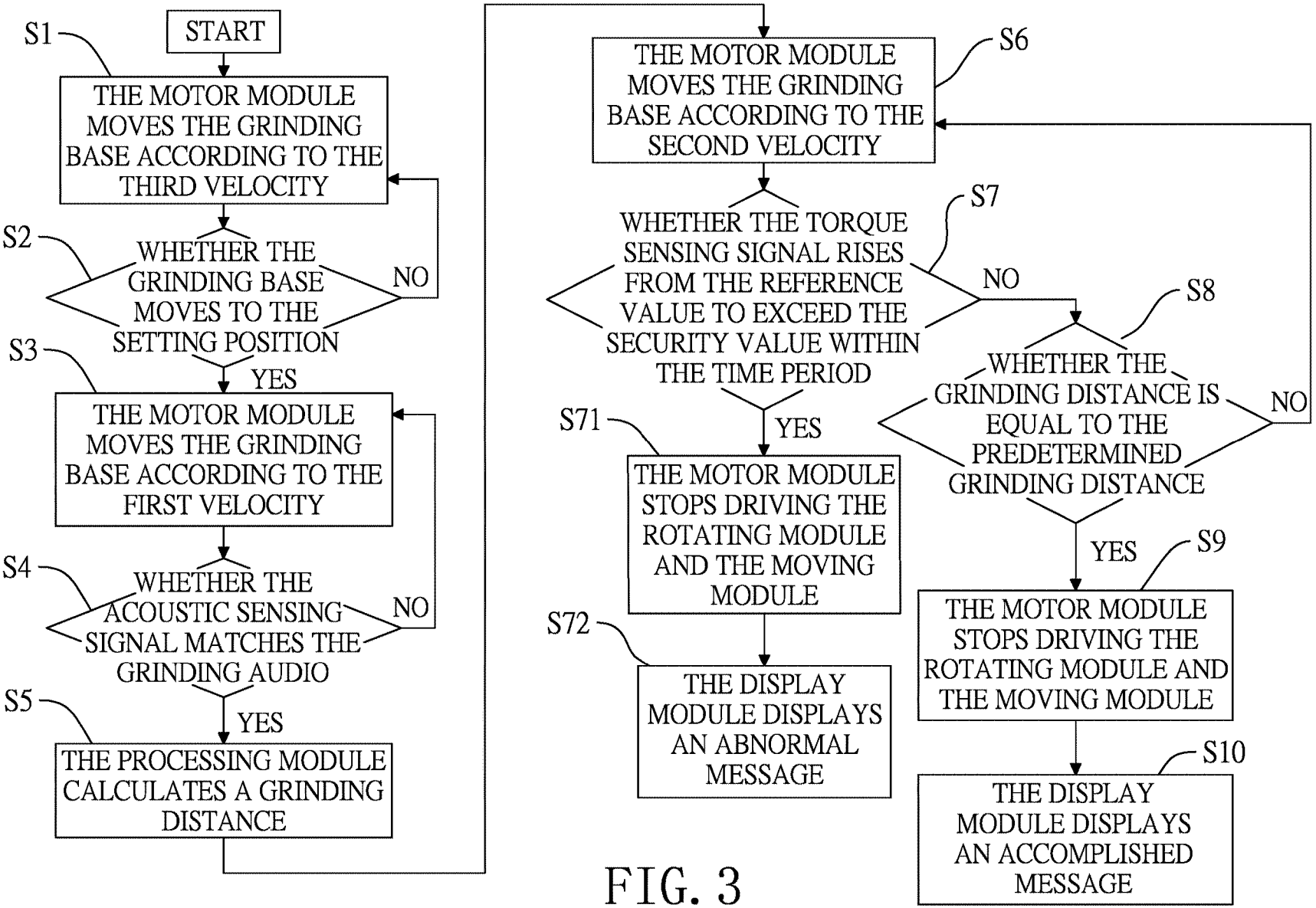
FIG. 3 is a flowchart of the first embodiment of the probe grinding device by acoustic positioning of the present invention.

Referring to FIG. 3, in details, before the processing module 20 determines that the grinding base 3 moves to the setting position, the processing module 20 generates a third velocity value according to the third velocity data to the motor module 10 so that the motor module 10 moves the grinding base 3 (S1) according to the third velocity. After the processing module 20 determines that the grinding base 3 moves to the setting position before the acoustic sensing signal matches the grinding audio, the processing module 20 generates a first velocity value according to the first velocity data to the motor module 10 so that the motor module 10 moves the grinding base 3 (S3) according to the first velocity. After that, the processing module 20 determines whether the acoustic sensing signal matches the grinding audio (S4). When the processing module 20 determines that the acoustic sensing signal fails to match the grinding audio, the motor module 10 constantly moves the grinding base 3 (S3) with the first velocity and re-determines whether the acoustic sensing signal matches the grinding audio (S4). After the processing module 20 determines that the acoustic sensing signal matches the grinding audio, the processing module 20 calculates a grinding distance (S5) and generates a second velocity value according to the second velocity data to the motor module 10 so that the motor module 10 moves the grinding base 3 (S6) according to the second velocity. In the embodiment, the first velocity is faster than the second velocity and the third velocity is faster than the first velocity.

In this way, when the grinding base 3 is far from the probes 7, that is, before the grinding base 3 moves to the setting position, the probe grinding device by acoustic positioning of the present invention is capable of moving the grinding base 3 at a high speed to reduce time. When the grinding base 3 is close to the probes 7, that is, the processing module 20 determines that the grinding base 3 is moved to the setting position before the grinding audio is detected, the probe grinding device by acoustic positioning moves the grinding base 3 at a low speed because the grinding base 3 may touch the probes 7 at any time. When the grinding base 3 touches and grinds the probes 7, that is, the processing module 20 determines that the grinding audio is generated, the probe grinding device by acoustic positioning moves the grinding base 3 with a safe velocity. In this way, the probe grinding device by acoustic positioning can avoid the probes 7 damaging because an extreme normal force is applied on the probes 7. The normal force is generated via moving the grinding base 3 toward the probes 7 by the motor module 10. The normal force will be diminished when the length of the probes 7 is gradually shortened by grinding. Hence, the slower the grinding base 3 moves toward the probes 7 and the more time the probes 7 are grinded, the less fracture the probes 7 suffer from being compressed. Therefore, the probes 7 can be protected.

The torque sensing module 50 is electrically connected to the processing module 20. The torque sensing module 50 senses a grinding torque for grinding the probes to generate a torque sensing signal and transmits the torque sensing signal to the processing module 20. When the processing module 20 generates the driving signal to the motor module 10 so that the motor module 10 rotates and moves the rotating module 6, the processing module 20 determines whether the torque sensing signal rises from the reference value to exceed the security value within the time period (S7). When the processing module 20 determines that the torque sensing signal rises from the reference value to exceed the security value within the time period, the processing module 20 generates a stopping signal to the motor module 10 and the motor module 10 stops driving the rotating module 6 and the moving module 5 (S71) according to the stopping signal.

In the embodiment, the torque sensing module 50 is a Hall sensor. The Hall sensor is disposed in the rotating module 6. The reference value is a torque value of the torque sensing signal when the grinding base 3 idles. The security value is the torque value of the torque sensing signal between 1.3 to 1.5 times larger than the reference value. To set the security value is to decrease the probability of damaging the probes 7. When the probes 7 are forced by the grinding base 3 and the grinding surface 4, the probes 7 will generate a reactive force. The value of the reactive force will be expressed on the torque sensing signal sensed by the torque sensing module 50. When the value of the torque sensing signal increases significantly, the probes 7 may receive an extreme force so that the probes 7 could be broken or fractured. Consequently, when the torque value of the torque sensing signal rises to the security value, the processing module 20 should respond to the condition real time to stop the work of grinding the probes for diminishing the degree for damaging the probes 7.

In addition, when the processing module 20 determines that the grinding audio is detected, the processing module 20 calculates the grinding distance (S5). When the processing module 20 determines that the torque sensing signal in the time period fails to rise from the reference value to exceed the security value, the processing module 20 further determines whether the grinding distance is equal to the predetermined grinding distance (S8). When the processing module 20 determines that the grinding distance is not equal to the predetermined grinding distance, the motor module 10 continuously moves the grinding base 3 with the second velocity (S6). The processing module 20 re-determines whether the torque sensing signal rises from the reference value to exceed the security value within the time period (S7). When the processing module 20 determines that the grinding distance is equal to the predetermined grinding distance, the processing module 20 generates a stopping signal to the motor module 10. The motor module 10 stops driving the rotating module 6 and the moving module 5 according to the stopping signal (S9). In this way, the grinding probe finishes being grinded. The probes 7 are grinded to the required length without continuously being grinded. The method for calculating the grinding distance by the processing module 20 is that the processing module 20 calculates the route distance when the grinding surface 4 touches the probes 7 according to a grinding time and a number of rotating the rotating module 6. In details, the processing module 20 calculates the grinding distance according to the material property of the probes 7. For example, the probe with higher hardness needs to be grinded via rotating the grinding surface 4 for 90 angles to accomplish grinding a unit length of the probe. The probe with lower hardness needs to be grinded via rotating the grinding surface 4 for 60 angles to accomplish being grinded a unit length of the probe. Therefore, for grinding the same unit length of the probe, the calculating method varies according to distinct material categories and different hardness.

When the processing module 20 determines that the torque sensing signal in the time period rises from the reference value to exceed the security value, the processing module 20 generates an abnormal signal and transmits the abnormal signal to the display module 70. The display module 70 displays an abnormal message according to the abnormal signal (S72). When the processing module 20 determines that the grinding distance is equal to the predetermined grinding distance, the processing module 20 generates an accomplished signal and transmits the accomplished signal to the display module 70. The display module 70 displays an accomplished message according to the accomplished signal (S10).

The display module 70 is electrically connected to the processing module 20. The display module 70 is a touch panel. The touch panel provides the user with the setting method of the present invention. The abnormal message and the accomplished message are text messages, displayed via the touch panel. In another embodiment, the display module 70 is a plurality of light signals. The user needs to set the configuration via connecting to the processing module 20, such as utilizing a USB port to connect to the processing module 20. The abnormal message and the accomplished message are light messages, displayed by different light signals.

Figure 4:
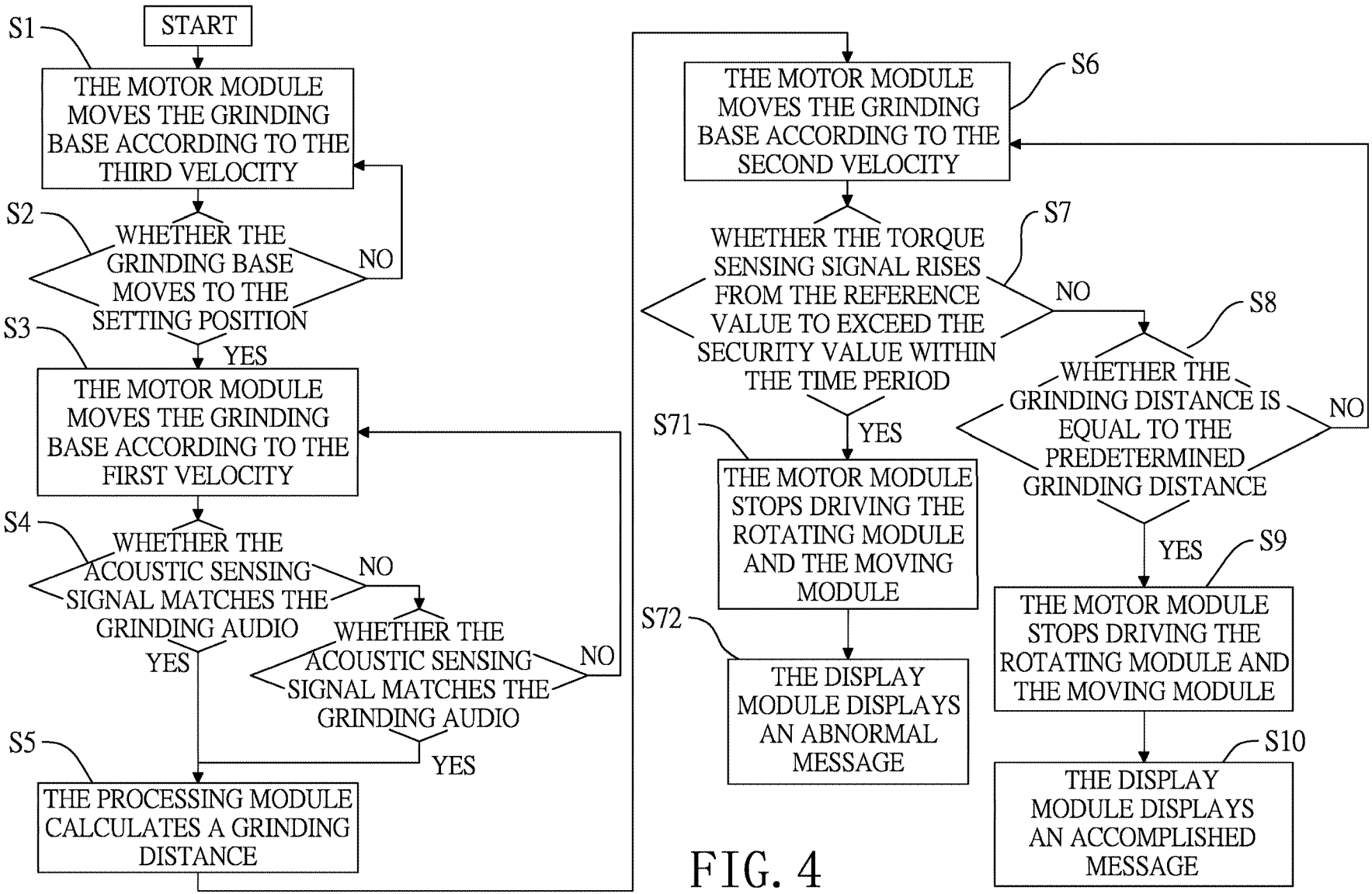
FIG. 4 is a flowchart of another embodiment of the probe grinding device by acoustic positioning of the present invention.

Referring to FIG. 4, in another embodiment, the reference data stored in the memory module 30 further includes a torque value for grinding the probe. The processing module 20 determines that the grinding base 3 moves to the setting position before the grinding audio is detected by the processing module 20, and the processing module 20 generates a first velocity to the motor module 10 according to the first velocity data. The motor module 10 moves the grinding base 3 with the first velocity (S3). Then, the processing module 20 determines whether the acoustic sensing signal matches the grinding audio according to the acoustic sensing signal (S4'). When the processing module 20 determines that the acoustic sensing signal fails to match the grinding audio, the processing module 20 further determines whether the torque value of the torque sensing signal is more than or equal to the torque value for grinding the probe (S41'). When the processing module 20 determines that the torque sensing signal is not more than or is not equal to the torque value for grinding the probe, the motor module 10 maintains moving the grinding base 3 with the first velocity (S3). The processing module 20 re-determines whether the acoustic sensing signal matches the grinding audio (S4'). When the processing module 20 determines that the torque sensing signal is more than or equal to the torque value for grinding the probe, the processing module 20 calculates the grinding distance (S5), and the motor module 10 moves the grinding base 3 with the second velocity according to the second velocity data (S6). Similarly, when the processing module 20 determines that the grinding distance is equal to the predetermined grinding distance, the processing module 20 generates a stopping signal to the motor module 10. The motor module 10 stops driving the rotating module 6 and the moving module 5 according to the stopping signal (S9). Relative to the torque value for grinding the probe, the torque sensing signal is regarded as the signal that the grinding base 3 idles and fails to touch the probes 7 before exceeding the torque value for grinding the probe, that is, the background signal measured by the torque sensing module 50.

That is, when the processing module 20 determines that the acoustic sensing signal matches the grinding audio or when the processing module 20 determines that the torque sensing signal is more than or equal to the torque value for grinding the probe, the processing module 20 determines that the grinding surface 4 touches and grinds the probes 7 and calculates the grinding distance. In this way, the processing module 20 has multiple methods to determine the position of the grinding base 3 and the position of the probes 7 via the torque sensing module 50 and the acoustic sensing module 40 to avoid damaging the probes 7 when the acoustic sensing module 40 is faulted.

When the grinding surface 4 is moved toward the probes 7, the primary standard for determining when the grinding surface 4 of the grinding base 3 touches the probes 7 in the present invention utilizes the acoustic sensing module 40 but not the image sensing module 60 or the torque sensing module 50. As mentioned in the prior art, the reason is that the image sensing module 60 is limited to its lens, failing to perfectly focus on each of the probes 7 even though the lens of the image sensing module 60 is capable of regulating a focal length. Since the lengths of each of the probes on the probe card 2 are distinct and the probes' positions on the probe card are different, the distances between the image sensing module 60 and the tips of the probes 7 are various. Consequently, in the condition that the grinding base 3 is easily located and the image sensing module 60 fails to perfectly regulate the focal length, the image sensing module 60 is utilized to locate the position of the grinding base 3 so that the processing module 20 determines whether the grinding base 3 is moved to the setting position according to the image sensing signal. It is unnecessary to satisfy the micron grade for the image resolution of locating the grinding base 3. Hence, in contrary to lens for observing the probes 7, the size and a cost of the lens of the image sensing module 60 in the present invention can be reduced.

Moreover, in contrast to the sensitivity of the torque sensing module 50 for sensing the torque, the sensitivity of the acoustic sensing module 40 for sensing sound is more sensitive when fewer probes 7 are grinded. Hence, the acoustic sensing module 40 is the primary module in the present invention for being selected to sense sound when the grinding surface 4 touches the probes 7. When fewer probes 7 are grinded, the resistance generated by the fewer probes 7 is finite. Therefore, in the torque sensing signal sensed by the torque sensing module 50, the vibration generated by the motor module 10 driving the rotating module 6 may cover the variation of the torque generated by the fewer probes being rubbed. In contrast, when the fewer probes 7 are grinded, noise generated by grinding the fewer probes 7 can be detected obviously since the acoustic sensing module 40 can detect whether the grinding audio corresponds to a specific frequency for grinding the probe. In details, the processing module 20 determines that the acoustic sensing signal matches the grinding audio in the specific frequency for grinding the probe when the acoustic sensing signal rises from the background decibel that the grinding base 3 idles to 30% to 50% decibel. In contrast to the sensitivity of the torque sensing module 50 for sensing torque, the acoustic sensing module 40 has a higher sensitivity for sensing the decibel variations of the specific frequency for grinding the probe. Consequently, the acoustic sensing module 40 has a great accuracy for determining whether the grinding surface 4 touches the probes 7.

In contrast to the acoustic sensing module 40, after the probes 7 are grinded, the torque sensing module 50 can accurately sense whether the probes 7 are compressed and the work for grinding the probe needs to be stopped real time. After major probes 7 are grinded, the probes 7 will generate significantly resistance, much more than the signal generated via the vibration detected by the torque sensing module 50. Hence, the torque sensing module 50 can detect whether the torque sensing signal in the time period rises from the reference value to exceed the security value. After the probes are grinded, the acoustic sensing module 40 is hard to determine how much stress the probes 7 bear from detecting the variations for the decibel of the acoustic sensing signal. Therefore, when the processing module 20 determines that the acoustic sensing signal matches the grinding audio, it is unnecessary for the acoustic sensing module 40 to sense the acoustic of grinding the probes.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A probe grinding device by acoustic positioning, comprising:

a fixing base, adapted to fix a probe card;

a grinding base, comprising a grinding surface, and the grinding surface facing to the fixing base; wherein when the probe card is fixed on the fixing base, a plurality of probes of the probe card face to the grinding base;

a rotating module, connected to the grinding base;

a moving module, connected to the rotating module;

a motor module, connected to the rotating module and the moving module;

a processing module, electrically connected to the motor module and generating a driving signal to the motor module; wherein the motor module drives the rotating module to rotate the grinding base and drives the moving module to move the grinding base toward the fixing base according to the driving signal;

an acoustic sensing module, electrically connected to the processing module, sensing sound to generate an acoustic sensing signal and transmitting the acoustic sensing signal to the processing module;

a memory module, electrically connected to the processing module, storing a grinding audio data; wherein the grinding audio data comprises a grinding audio;

wherein when the processing module drives the rotating module and the moving module via the motor module, the processing module further determines whether the acoustic sensing signal matches the grinding audio stored in the memory module;

wherein when the processing module determines that the acoustic sensing signal matches the grinding audio, the processing module drives the moving module via the motor module to slow down a moving velocity of the grinding base.

2. The probe grinding device by acoustic positioning as claimed in claim 1, wherein the memory module stores a first velocity data and a second velocity data;

wherein before the processing module determines whether the acoustic sensing signal matches the grinding audio, the processing module generates a first velocity according to the first velocity data, the motor module drives the moving module with the first velocity, and the moving module moves the grinding base toward the fixing base;

wherein after the processing module determines that the acoustic sensing signal matches the grinding audio, the processing module generates a second velocity according to the second velocity data, the motor module drives the moving module with the second velocity, and the moving module moves the grinding base toward the fixing base;

wherein the first velocity is more than the second velocity.

3. The probe grinding device by acoustic positioning as claimed in claim 1, further comprising:

an image sensing module, electrically connected to the processing module, sensing an image to generate an image sensing signal, and transmitting the image sensing signal to the processing module;

wherein the memory module further stores a setting position data, comprising a setting position;

wherein when the processing module drives the rotating module and the moving module via the motor module, the processing module determines whether the grinding base moves to the setting position according to the image sensing signal;

wherein when the processing module determines that the grinding base moves to the setting position, the processing module drives the moving module via the motor module to slow down a moving velocity of the grinding base.

4. The probe grinding device by acoustic positioning as claimed in claim 3, wherein the memory module stores a third velocity data;

wherein when the processing module drives the moving module via the motor module, the processing module generates a third velocity to the motor module and the motor module drives the moving module with the third velocity to move the grinding base toward the fixing base;

wherein when the processing module determines that the grinding base moves to the setting position, the processing module generates a first velocity to the motor module and the motor module drives the moving module with the first velocity to move the grinding base toward the fixing base;

wherein when the processing module determines that the acoustic sensing signal matches the grinding audio, the processing module generates a second velocity to the motor module and the motor module drives the moving module with the second velocity to move the grinding base toward the fixing base;

wherein the third velocity is more than the first velocity and the first velocity is more than the second velocity.

5. The probe grinding device by acoustic positioning as claimed in claim 1, further comprising:

a torque sensing module, electrically connected to the processing module, sensing a grinding torque of the grinding probe to generate a torque sensing signal and transmitting the torque sensing signal to the processing module;

wherein the memory module further stores a reference data and the reference data comprises a time period, a reference value, and a security value;

wherein when the processing module drives the rotating module and the moving module via the motor module, the processing module determines whether the torque sensing signal is raised from the reference value to exceed the security value within the time period;

wherein when the processing module determines that the torque sensing signal in the time period is raised from the reference value to exceed the security value, the processing module generates a stopping signal to the motor module, and the motor module stops driving the rotating module and the moving module.

6. The probe grinding device by acoustic positioning as claimed in claim 5, wherein the reference data further comprises a predetermined grinding distance;

wherein when the processing module determines that the acoustic sensing signal matches the grinding audio, the processing module further calculates a grinding distance and determines whether the grinding distance is equal to the predetermined grinding distance;

wherein when the processing module determines that the grinding distance is equal to the predetermined grinding distance, the processing module generates the stopping signal to the motor module, and the motor module stops driving the rotating module and the moving module.

7. The probe grinding device by acoustic positioning as claimed in claim 6, further comprising:

a display module, electrically connected to the processing module;

wherein when the processing module determines that the torque sensing signal is raised from the reference value to exceed the security value within the time period, the processing module generates an abnormal signal and transmits the abnormal signal to the display module, and the display module displays an abnormal message according to the abnormal signal;

wherein when the processing module determines that the grinding distance is equal to the predetermined grinding distance, the processing module generates an accomplished signal and transmits the accomplished signal to the display module, and the display module displays an accomplished message according to the accomplished signal.

8. The probe grinding device by acoustic positioning as claimed in claim 1, further comprising:

a torque sensing module, electrically connected to the processing module, sensing a grinding torque of the grinding probe to generate a torque sensing signal and transmitting the torque sensing signal to the processing module; and the memory module further storing a reference data and the reference data comprising a torque value for grinding the probe;

wherein when the processing module determines that the acoustic sensing signal fails to match the grinding audio, the processing module further determines whether the torque sensing signal is more than or equal to the torque value for grinding the probe;

wherein when the processing module determines that the torque sensing signal is more than or equal to the torque value for grinding the probe, the processing module drives the moving module via the motor module to slow down a moving velocity of the grinding base.

9. The probe grinding device by acoustic positioning as claimed in claim 8, wherein the reference data further comprises a predetermined grinding distance;

wherein when the processing module determines that the torque sensing signal is more than or equal to the torque value for grinding the probe, the processing module calculates a grinding distance, and the processing module determines whether the grinding distance is equal to the predetermined grinding distance;

wherein when the processing module determines that the grinding distance is equal to the predetermined grinding distance, the processing module generates a stopping signal to the motor module, and the motor module stops driving the rotating module and the moving module.

10. The probe grinding device by acoustic positioning as claimed in claim 5, wherein the reference value is a torque value of the torque sensing signal when the grinding base idles and the security value is the torque value of the torque sensing signal between 1.3 to 1.5 times larger than the reference value.

11. The probe grinding device by acoustic positioning as claimed in claim 6, wherein the reference value is a torque value of the torque sensing signal when the grinding base idles and the security value is the torque value of the torque sensing signal between 1.3 to 1.5 times larger than the reference value.

12. The probe grinding device by acoustic positioning as claimed in claim 7, wherein the reference value is a torque value of the torque sensing signal when the grinding base idles and the security value is the torque value of the torque sensing signal between 1.3 to 1.5 times larger than the reference value.

* * * * *